US006521193B1

(12) United States Patent
Hijikata et al.

(10) Patent No.: US 6,521,193 B1
(45) Date of Patent: Feb. 18, 2003

(54) CERAMIC HONEYCOMB GAS DUCT ASSEMBLY AND METHOD OF MAKING THE SAME

(75) Inventors: Toshihiko Hijikata, Nagoya (JP); Yukiharu Morita, Nagoya (JP)

(73) Assignee: NGK Insulators, Ltd. (JP)

( * ) Notice: Subject to any disclaimer, the term of this patent is extended or adjusted under 35 U.S.C. 154(b) by 0 days.

(21) Appl. No.: 09/482,120

(22) Filed: Jan. 13, 2000

(30) Foreign Application Priority Data

Jan. 14, 1999 (JP) ..... 11-008514

(51) Int. Cl.[7] ..... B01D 53/92; F01N 3/28
(52) U.S. Cl. ..... 422/179; 422/177; 422/180
(58) Field of Search ..... 422/177, 180, 422/179, 221, 222; 60/299, 300

(56) References Cited

U.S. PATENT DOCUMENTS

| | | | | |
|---|---|---|---|---|
| 4,698,213 A | * | 10/1987 | Shimozi et al. | 422/179 |
| 4,925,634 A | | 5/1990 | Yokokoji et al. | 422/179 |
| 4,929,429 A | | 5/1990 | Merry | 422/179 |
| 5,293,743 A | * | 3/1994 | Usleman et al. | 422/179 |
| 5,866,079 A | | 2/1999 | Machida et al. | 422/179 |

FOREIGN PATENT DOCUMENTS

| | | | |
|---|---|---|---|
| EP | 643204 | * | 3/1995 |
| JP | 49-72173 | | 7/1974 |
| JP | 58-32917 | | 2/1983 |
| JP | 62-28012 | | 2/1987 |
| JP | 62-176522 | | 8/1987 |
| JP | 01-87818 | | 3/1989 |
| JP | 7-77036 | | 3/1995 |
| JP | 10-337480 | | 12/1998 |

* cited by examiner

*Primary Examiner*—Hien Tran
(74) *Attorney, Agent, or Firm*—Parkhurst & Wendel, L.L.P.

(57) ABSTRACT

A gas duct includes a ceramic honeycomb structure includes a metal case, a ceramic honeycomb structure accommodated in the metal case, and a holding member placed between the outer surface of the ceramic honeycomb structure and the inner surface of the metal case. The holding member has, at the two ends, to-be-connected areas engageable to each other and is wound round the outer surface of the ceramic honeycomb structure in such a way that the to-be-connected areas of the two ends are engaged to each other and that the connected area and its vicinity face the partition wall of each cell constituting the honeycomb structure. In the gas duct, even when the ceramic honeycomb structure has thin partition walls, the honeycomb structure is not broken when it is accommodated in a metal case, i.e. during the canning.

11 Claims, 5 Drawing Sheets

CERAMIC HONEYCOMB GAS DUCT ASSEMBLY AND METHOD OF MAKING THE SAME

BACKGROUND OF THE INVENTION (1) Field of the Invention

The present invention relates to a gas duct comprising a ceramic honeycomb structure, used mainly in an exhaust gas purification system for automobile.

(2) Description of Related Art

Currently, gas ducts comprising a honeycomb structure are in extensive use because they are low in pressure loss (when an exhaust gas is passed therethrough) owing to the high porosity and show an excellent exhaust gas purifiability. As an example of such gas ducts, there is widely known a ceramic honeycomb catalytic converter used in an exhaust gas purification system for automobile; and it is disclosed in, for example, JP-A-49-72173 and JP-A-7-77036.

In such ducts comprising a ceramic honeycomb structure, a ceramic honeycomb structure is fitted to a gas duct in a state that it is accommodated in a metal case, in order to allow the easy handling of the ceramic honeycomb structure. At this time, a holding member made of, for example, a ceramic fiber mat is allowed to be present, in a compressed state, between the outer surface of the honeycomb structure and the inner surface of the metal case, in order to reliably hold the honeycomb structure in the metal case and also lessen the impact applied from outside.

As the method for accommodating a honeycomb structure in a metal case via a holding member, there are generally known three methods, i.e. a stuffing method, a tourniquet method and a clamshell method. The stuffing method is shown in FIG. 2(*a*) and comprises winding a holding member 1 round a ceramic honeycomb structure 2 and forcing the resulting material in a metal case 3 from its one opening. In this method, as shown in FIGS. 2(*b*) and 2(*c*), the two ends of the holding member 1 have to-be-connected areas 13 engageable to each other; the holding member 1 is wound round the outer surface of the honeycomb structure 2 and the to-be-connected areas 13 of the two ends of the honeycomb structure 1 are engaged to each other and fixed. The compression of the holding member 1 is conducted by, as shown in FIG. 2(*d*), forcing the honeycomb structure 2 covered with the holding member 1, in the metal case 3 using an insertion-assisting jig 5 of ring shape having such an inner diameter as decreases gradually from one end of the ring to the other end.

The tourniquet method comprises winding a holding member 1 round a honeycomb structure 2 as shown in FIGS. 3(*a*) and 3(*b*), inserting the resulting material into a metal case 3, placing the resulting material in between upper and lower wire ropes 18 as shown in FIG. 7, pulling the ropes upward and downward at a given load to clamp the case 3 and resultantly compress the holding member 1, thereby fixing the honeycomb structure 2 in the metal case 3.

The clamshell method comprises winding a holding member round a honeycomb structure, placing the resulting material in one pair of opposing metallic half shells having a shape symmetric to each other, and welding the half shells to each other.

As the regulation for exhaust gas emission has become stricter recently in connection with the environmental protection and, for example, a lower level has come to be required for the total hydrocarbon emission in the LA-4 mode which is one of the exhaust gas evaluation tests in U.S.A, ceramic honeycomb catalysts are desired to exhibit exhaust gas purifiability which is higher than before. Catalysts are not sufficiently heated and therefore are not sufficiently activated and the purification efficiency is significantly low, at the start of engine, i.e. the cold start. Thus, the early activation of catalyst at cold start is considered to be the most important task for achieving the regulation for exhaust gas emission. From this standpoint, there was made a proposal of (1) making the partition wall of ceramic honeycomb catalyst as thin as possible and making the open frontal area of the honeycomb catalyst as high as possible to reduce the pressure loss and (2) reducing the weight of honeycomb structure and lowering the heat capacity of catalyst to increase the temperature elevation rate of catalyst. In this proposal, since a large geometrical surface area is obtainable, a honeycomb catalyst of small size can be produced. From such a standpoint, there has recently been developed a ceramic honeycomb structure having thin partition walls of 0.03 to 0.10 mm in thickness In a ceramic honeycomb structure having thin partition walls, however, it is difficult to achieve the minimum guaranteed value (10 kgf/cm$^2$) for the isostatic fracture strength which is an index of the strength of structure. Herein, "isostatic strength" is specified in the JASO standard M 505-87 which is a standard for automobile issued by Society of Automotive Engineers of Japan, Inc., and is expressed as a load at which fracture appears when an isostatic hydrostatic load is applied to a honeycomb structure.

Therefore, in the gas duct comprising a honeycomb structure, when a honeycomb structure having thin partition walls is accommodated in a metal case according to a conventional method, there has been a problem in that in the canning operation of accommodating the honeycomb structure in the metal case via a holding member, the honeycomb structure is fractured by the tourniquet of the holding member.

SUMMARY OF THE INVENTION

In view of the above-mentioned situation, the present invention aims at providing a gas duct comprising a ceramic honeycomb structure, wherein even when the ceramic honeycomb structure has thin partition walls, the honeycomb structure is not fractured when it is accommodated in a metal case, i.e. during the canning.

The presently claimed invention provides a gas duct having a ceramic honeycomb structure, with the following: a metal case, a ceramic honeycomb structure in the metal case; and a holding member between the outer surface of the ceramic honeycomb structure and the inner surface of the metal case. The holding member has two engageable ends and when the holding member is wound round the outer surface of the honeycomb structure the two ends engage each other. This engagement occurs in a connection area. The connection area and its vicinity face a plurality of partition walls of the honeycomb structure.

In the above gas duct, the honeycomb structure may be accommodated in the metal case by winding the holding member round the honeycomb structure and then forcing the resulting material in the metal case from one opening of the metal case.

In the above gas duct, each to-be-connected area of the holding member preferably has, in the winding direction, a length of 20 to 50 mm or of 5 to 15% based on the length of the holding member in the winding direction.

The present invention further provides a gas duct having a ceramic honeycomb structure, which comprises:

a metal case, a ceramic honeycomb structure accommodated in the metal case, and a holding member placed between the outer surface of the ceramic honeycomb structure and the inner surface of the metal case, wherein the holding member is wound round the outer surface of the honeycomb structure, the metal case is formed by winding a metal plate round the holding member in such a way that the two ends of the metal plate are overlapped with each other and then tourniquet the metal plate, and the vicinity of the inner end of the overlapped two ends is allowed to face the partition wall of each cell constituting the honeycomb structure.

In the gas duct of the present invention, the partition walls of the ceramic honeycomb structure may have a thickness of less than 0.1 mm. Also, the cells of the ceramic honeycomb structure preferably have a tetragonal sectional shape. Also, the honeycomb structure may be a catalyst for exhaust gas purification.

Further in the gas duct of the present invention, the holding member is preferably a mat made of a ceramic fiber. Also, the pressure generated when the holding member is compressed, is, at a temperature range at which the gas duct is in actual use, preferably less than two times the pressure at normal temperature.

BRIEF DESCRIPTION OF THE DRAWINGS

FIG. 1(*b*) is a perspective view showing an example of the positional relationship of the ends of metal plate (later becoming a metal case) and the partition walls of honeycomb structure, in the gas dust of the present invention.

FIG. 2(*b*) is a schematic view showing an example of a holding member; FIG. 2(*c*) is a schematic view showing other example of a holding member; and FIG. 2(*d*) is a schematic sectional view showing a method for accommodating a honeycomb structure in a metal case according to a stuffing method.

FIG. 3(*b*) is a perspective view showing other example of a state in which a honeycomb structure has been accommodated in a metal case according to a tourniquet method.

DESCRIPTION OF PREFERRED EMBODIMENTS

Figure 1A:
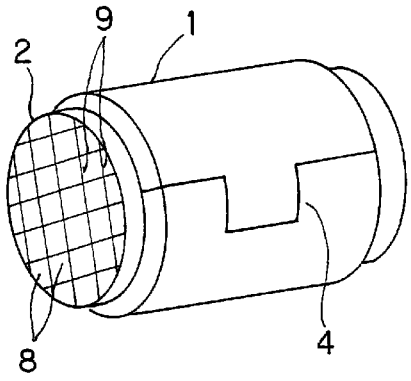
FIG. 1(*a*) is a perspective view showing an example of the positional relationship of the connected area of holding member and the partition walls of honeycomb structure, in the gas duct of the present invention.
Figure 1B:
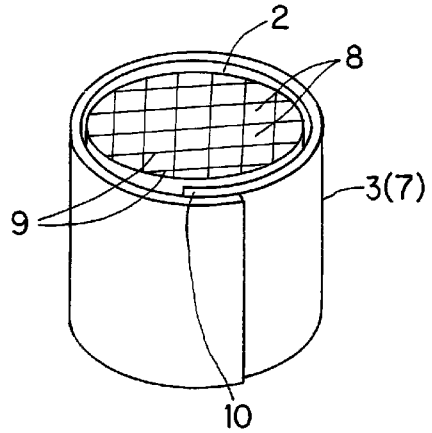
Figure 2D:
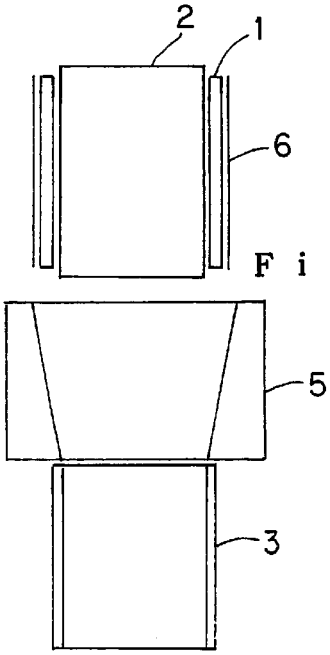
FIG. 2(*a*) is a perspective view showing a state in which a holding member has been wound round a honeycomb structure.
Figure 2B:
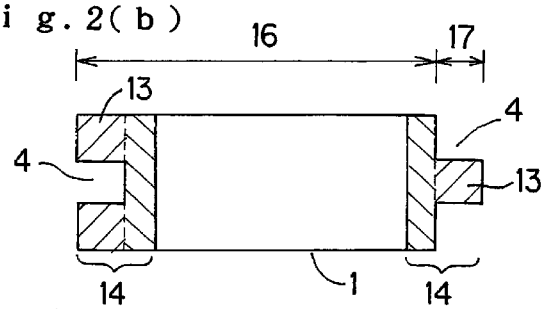
Figure 2C:
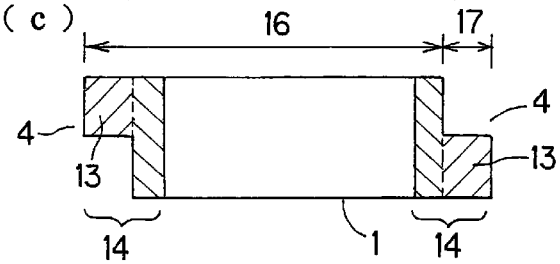
Figure 2A:
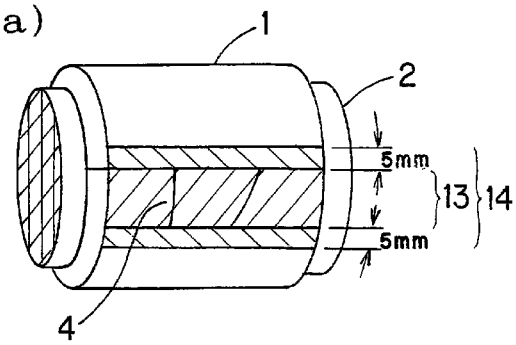

In the gas duct of the present invention, when a ceramic honeycomb structure is accommodated in a metal case according to a stuffing method, a holding member 1 having, at the two ends, to-be-connected areas engageable to each other is wound round the outer surface of a ceramic honeycomb structure 2, as shown in FIG. 1(*a*), in such a way that the to-be-connected areas of the two ends are engaged to each other and that the connected area 4 and its vicinity face the partition wall 9 of each cell 8 constituting the honeycomb structure.

Also in the present gas duct, when a ceramic honeycomb structure is accommodated in a metal case according to a tourniquet method, the vicinity of the inner end 10 of the overlapped two ends of a metal plate 7 (later becoming a metal case 3) is allowed to face the partition 9 of each cell 8 constituting a honeycomb structure 2, as shown in FIG. 1(*b*).

Figure 4:
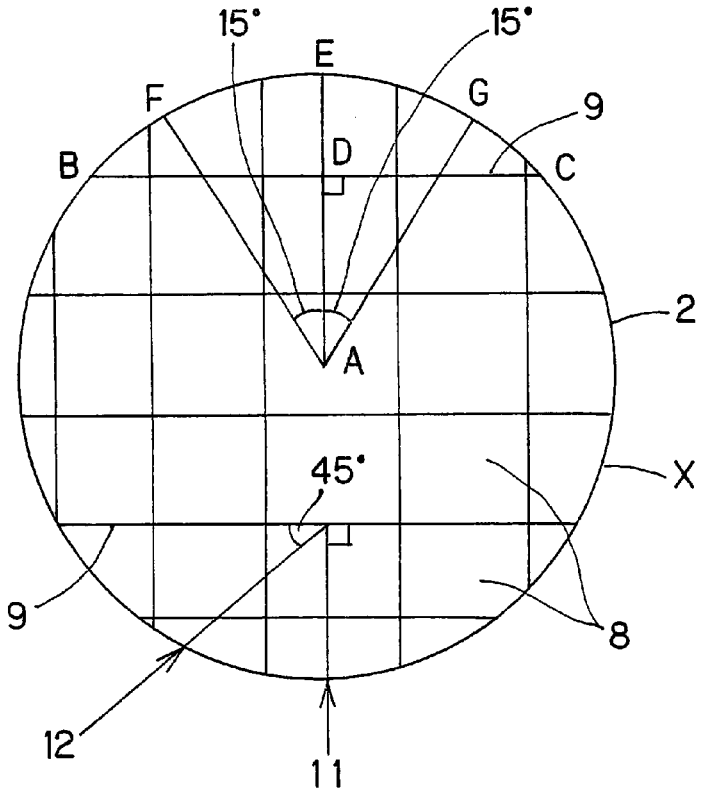
FIG. 4 is a schematic view showing the relation of the strength of honeycomb structure and the direction of force applied thereto.

As shown in FIG. 4, the cells constituting the honeycomb structure are strongest to a force 11 having a vector perpendicular to partition walls 9; become weak as the direction of force becomes oblique to the partition walls 9; and are weakest to a force 12 having an angle of 45° to the partition walls 9. Meanwhile, when a ceramic honeycomb structure is accommodated in a metal case via holding member according to a stuffing method, the holding member shows the highest pressure at the connected area and its vicinity; when a ceramic honeycomb structure is accommodated in a metal case according to a tourniquet method, the metal plate (later becoming a metal case) shows the highest pressure at the vicinity of the inner end of the overlapped two ends. Thus, the honeycomb structure undergoes the highest pressure from the connected area and its vicinity of the holding member or from the vicinity of the inner end of the overlapped two ends of the metal plate.

In the present invention, therefore, the connected area 4 and its vicinity of a holding member 1 or the vicinity of the inner end 10 of the overlapped two ends of a metal plate 7 is allowed to face the partition walls 9 of the cells 8 constituting a honeycomb structure 2, as shown in FIG. 1(*a*) or 1(*b*), whereby the highest pressure of the connected area 4 and its vicinity or the vicinity of the inner end 10 of the overlapped two ends of the metal plate 7 is applied approximately perpendicularly to the surface of the partition walls 9 of cells 8. As a result, in the gas duct of the present invention, the ceramic honeycomb structure, even when having thin partition walls of 0.03 to 0.10 mm, is not fractured by the pressure from the holding member or the metal case during canning or during use.

Incidentally, in the present invention, "the connected area and its vicinity" refer to, as shown in FIGS. 2(*a*), 2(*b*) and 2(*c*), an area of a holding member 1 which is a connected area 4 plus two areas adjacent thereto, each of 5 mm in width.

Figure 3A:
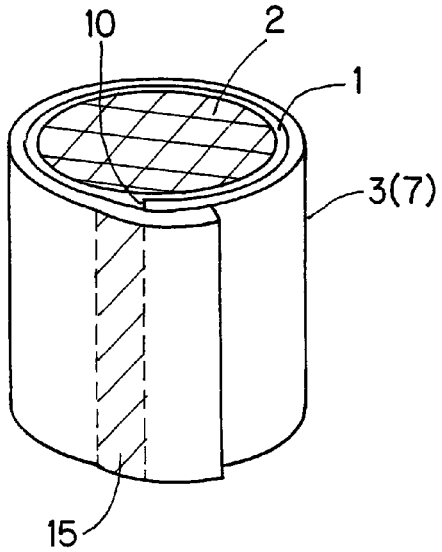
FIG. 3(*a*) is a perspective view showing an example of a state in which a honeycomb structure has been accommodated in a metal case according to a tourniquet method.
Figure 3B:
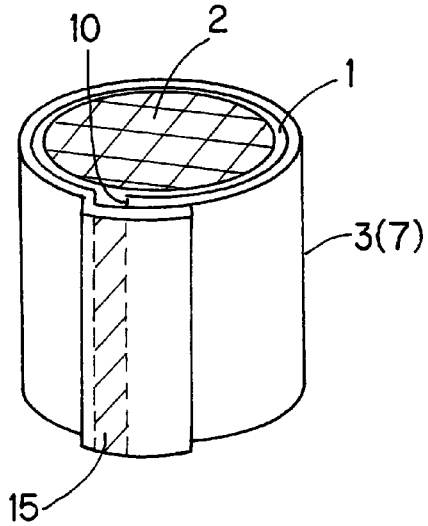

"The vicinity of the inner end" refers to, as shown in FIGS. 3(*a*) and 3(*b*), an area 15 of 30 mm in width extending from the inner end 10 of the overlapped two ends of a metal plate in its tourniquet direction.

The expression " . . . faces the partition walls of cells" is explained by the following discussion. As shown in FIG. 4, a perpendicular line, AD, from the center, A, of the section of a honeycomb structure 2 to a line segment BC defined by the partition wall 9 of cells 8. An intersection point of the perpendicular AD and the circumference X of the section is taken as point E. Lines AF and AG, each having an angle of 15° to the line segment AE, are drawn from the center A, and the intersection points of the straight line AF or AG and the circumference X are taken as F and G, respectively. Thus, "the connection (or connected) area and its vicinity face the partition walls of cells" refers to the connection (or connected) area being between the intersection points F and G. Similarly, "the vicinity of the inner end of the overlapped two ends of the metal plate face the partition walls of cells" refers to the inner ends of the overlapped two ends of the metal plate being between the intersection points F and G.

In the gas duct of the present invention, when a honeycomb structure is accommodated in a metal case via a holding member according to the stuffing method, the to-be-connected area of the holding member preferably has, in the winding direction, a length 17 [see FIGS. 2(*b*) and 2(*c*)] of 20 to 50 mm or of 5 to 15% based on the length 16 [see FIGS. 2(*a*) and 2(*b*)] of the holding member in the winding direction. When the length of the to-be-connected area is smaller than the above range, the overlapping (sealing) width of the holding member is small owing to the scatter in diameter of honeycomb structure, and gas leakage may occur. When the length of the to-be-connected area is larger than the above range, the total area of the connected area and its vicinity is large, and it is difficult to allow the connected area and its vicinity to face the partition walls of cells. The length 17 of the to-be-connected in the winding direction is more preferably 25 to 40 mm or 7 to 10% based on the length 16 of the holding member in the winding direction.

The gas duct of the present invention is most suitable for a honeycomb structure having a tetragonal sectional shape. However, the gas duct is also suitable for a honeycomb structure having a triangular sectional shape.

When a gas duct of the present invention type is used at high temperatures, there is a fear that the holding member expands and thereby an excess pressure is applied to the ceramic honeycomb structure, resulting in fracture of the honeycomb structure. To prevent such a case, it is preferred in the gas duct of the present invention that the pressure generated when the holding member is compressed, is, at a temperature range at which the gas duct is in actual use, less than two times the pressure at normal temperature. Herein, "a temperature range at which the gas duct is in actual use" refers to 300 to 1,000° C. and "normal temperature" refers to 0 to 40° C.

In the present invention, there is no particular restriction as to the material of the holding member. However, alumina, aluminosilicate or the like is preferably used, and a mat made of a ceramic fiber is more preferred for its excellent heat resistance.

In the present invention, there is no restriction, either, as to the honeycomb structure, i.e. its sectional shape (e.g. circular, oval, race track-shaped), size, partition wall thickness, cell density, cell pitch, etc. Thus, various honeycomb structures of different make can be used.

The present invention is described in more detail below by way of Examples and referring to the accompanying drawings. However, the present invention is in no way restricted to these Examples.

EXAMPLE 1

Each of 20 ceramic honeycomb structures having a length of 114 mm and a circular section of 106 mm in diameter was accommodated in a metal case via a holding member according to a stuffing method, and the number of the honeycomb structures damaged by the stuffing was examined.

The stuffing of each honeycomb structure in the metal case was conducted as follows.

A holding member 1 shown in FIG. 2(*b*) having, at the two ends, to-be-connected areas 13 engageable to each other was wound round the outer surface of a honeycomb structure 2, as shown in FIG. 2(*a*), in such a way that the to-be-connected areas of the two ends were engaged to each other and that the total area 14 of the connected area and its vicinity faced the partition walls 9 of the cells constituting the honeycomb structure; thereby, the holding member 1 was fixed to the honeycomb structure 2. The resulting material was stuffed, as shown in FIG. 2(*d*), in a metal case 3 using an insertion-assisting jig 5 of ring shape having such an inner diameter as decreased gradually from one end of the ring to the other end. The set pressure was 4 kg/cm$^2$. In the stuffing, a sliding tape 6 was provided on the outer surface of the holding member 1.

In the honeycomb structures used above, the cells had a tetragonal sectional shape; the thickness of the partition walls was 0.03 mm; and the cell density was 280 cells/cm$^2$. The average isostatic strength of the honeycomb structure of the same production lot as that of the 20 honeycomb structures used above was 6 kg/cm$^2$, and the range of the isostatic strengths was 5 to 7 kg/cm$^2$. Incidentally, the measurement of isostatic strength was made according to JASO Standard M 505-87. As the holding member, there was used a non intumescent mat made of a ceramic fiber [Maftec (trade name), a product of Mitsubishi Chemical Corporation].

The results are shown in Table 1.

EXAMPLES 2 AND 3

Each of 20 ceramic honeycomb structures was accommodated in a metal case in the same manner as in Example 1 according to a stuffing method, and the number of the honeycomb structures damaged by the stuffing was examined. The sectional shape of cells, thickness of partition walls, dell density, average isostatic strength, etc. of the honeycomb structures used were appropriately varied from those of the honeycomb structures used in Example 1. These data and the test results are shown in Table 1.

EXAMPLE 4

Each of 20 ceramic honeycomb structures having a length of 114 mm and a circular section of 106 mm in diameter was accommodated in a metal case via a holding member according to a tourniquet method, and the number of the honeycomb structures damaged by the tourniquet was examined.

The accommodation of each honeycomb structure in the metal case was conducted as follows.

As shown in FIG. 3(*b*), a holding member 1 was wound round the outer surface of a honeycomb structure 2 and clamped; then, the resulting material (the honeycomb structure 2 and the holding member 1) was accommodated in a metal plate 7 (later becoming a metal case 3) in such a way that the vicinity 15 of the inner end 10 of the overlapped two ends of the metal plate 7 faced the partition walls of the cells 8 constituting the honeycomb structure; thereafter, the two ends of the metal plate 7 were overlapped and fixed. The set pressure was 4 kg/cm$^2$. As the holding member 1, there was used a non intumescent mat made of a ceramic fiber [Maftec (trade name), a product of Mitsubishi Chemical Corporation].

TABLE 1

| | Method of accommodation | Honeycomb structure: Sectional shape of cells | Thickness of partition walls (mm) | Cell density (cells/cm$^2$) | Average isostatic strength (kg/cm$^2$) | Range of isostatic strength (kg/cm$^2$) | Number of tested samples | Number of damaged samples | Ratio of damaging (%) |
|---|---|---|---|---|---|---|---|---|---|
| Example 1 | Stuffing | Tetragonal | 0.03 | 280 | 6 | 5–7 | 20 | 0 | 0 |
| Example 2 | Stuffing | Tetragonal | 0.11 | 60 | 12 | 10–15 | 20 | 0 | 0 |
| Example 3 | Stuffing | Tetragonal | 0.09 | 60 | 7 | 5–10 | 20 | 0 | 0 |
| Example 4 | Tourniquet | Tetragonal | 0.09 | 60 | 7 | 5–10 | 20 | 0 | 0 |
| Comp. Ex. 1 | Stuffing | Tetragonal | 0.03 | 280 | 6 | 5–7 | 20 | 20 | 100 |
| Comp. Ex. 2 | Stuffing | Tetragonal | 0.11 | 60 | 12 | 10–15 | 20 | 1 | 5 |
| Comp. Ex. 3 | Stuffing | Tetragonal | 0.09 | 60 | 7 | 5–10 | 20 | 12 | 60 |
| Comp. Ex. 4 | Tourniquet | Tetragonal | 0.09 | 60 | 7 | 5–10 | 20 | 5 | 25 |

The sectional shape of cells, thickness of partition walls, dell density, average isostatic strength and range of isostatic strengths of the honeycomb structures used, as well as the test results are shown in Table 1. Incidentally, the measurement of isostatic strength was made according to JASO Standard M 505-87.

Comparative Example 1

Each of 20 ceramic honeycomb structures was accommodated in a metal case in the same manner as in Example 1 according to a stuffing method, and the number of the honeycomb structures damaged by the stuffing was examined. In the accommodation, however, the connected area and its vicinity of the holding member was not allowed to face the partition walls of the cells constituting the honeycomb structure. The results are shown in Table 1.

Comparative Example 2

Each of 20 ceramic honeycomb structures was accommodated in a metal case in the same manner as in Example 2 according to a stuffing method, and the number of the honeycomb structures damaged by the stuffing was examined. In the accommodation, however, the connected area and its vicinity of the holding member was not allowed to face the partition walls of the cells constituting the honeycomb structure. The results are shown in Table 1.

Comparative Example 3

Each of 20 ceramic honeycomb structures was accommodated in a metal case in the same manner as in Example 3 according to a stuffing method, and the number of the honeycomb structures damaged by the stuffing was examined. In the accommodation, however, the connected area and its vicinity of the holding member was not allowed to face the partition walls of the cells constituting the honeycomb structure. The results are shown in Table 1.

Comparative Example 4

Each of 20 ceramic honeycomb structures was accommodated in a metal case in the same manner as in Example 4 according to a tourniquet method, and the number of the honeycomb structures damaged by the tourniquet was examined. In the accommodation, however, the vicinity of the inner end of the overlapped two ends of the metal plate was not allowed to face the partition walls of the cells constituting the honeycomb structure. The results are shown in Table 1.

As is clear from Table 1, no honeycomb structure was damaged in Examples, but 5 to 100% of the honeycomb structures tested were damaged in Comparative Examples.

Reference Example 1

There were measured the pressures applied to various sites of a honeycomb structure when the honeycomb structure was accommodated in a metal case according to a stuffing method to form a gas duct.

Measurement of pressure was conducted as follows.

Figure 5:
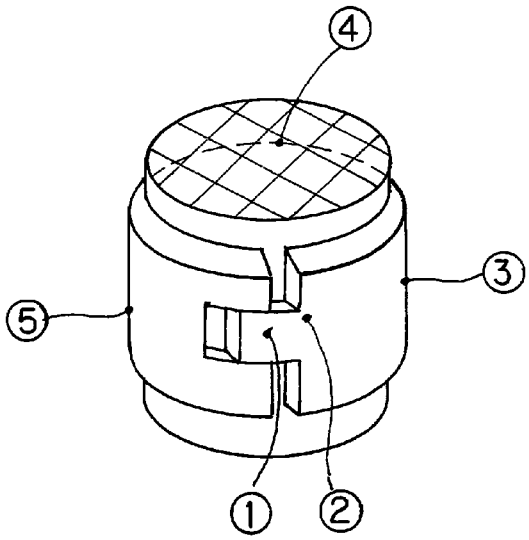
FIG. 5 is a perspective view showing the measurement sites in the pressure measurement test of Reference Example 1.

A holding member 1 having, at the two ends, to-be-connected areas engageable to each other was wound round the outer surface of a honeycomb structure 2 having a sheet-shaped pressure sensor thereon; then, the to-be-connected areas of the overlapped two ends of the holding member 1 were engaged to each other and fixed. Next, as shown in FIG. 2(*d*), a sliding tape 6 was provided on the outer surface of the holding member 1 and the resulting material was inserted into a metal case 3 using an insertion-assisting jig 5 of ring shape having such an inner diameter as decreased gradually from one end of the ring to the other end. The set pressure was 4 kg/cm$^2$. Pressure measurement was made at 5 sites shown in FIG. 5.

Figure 6:
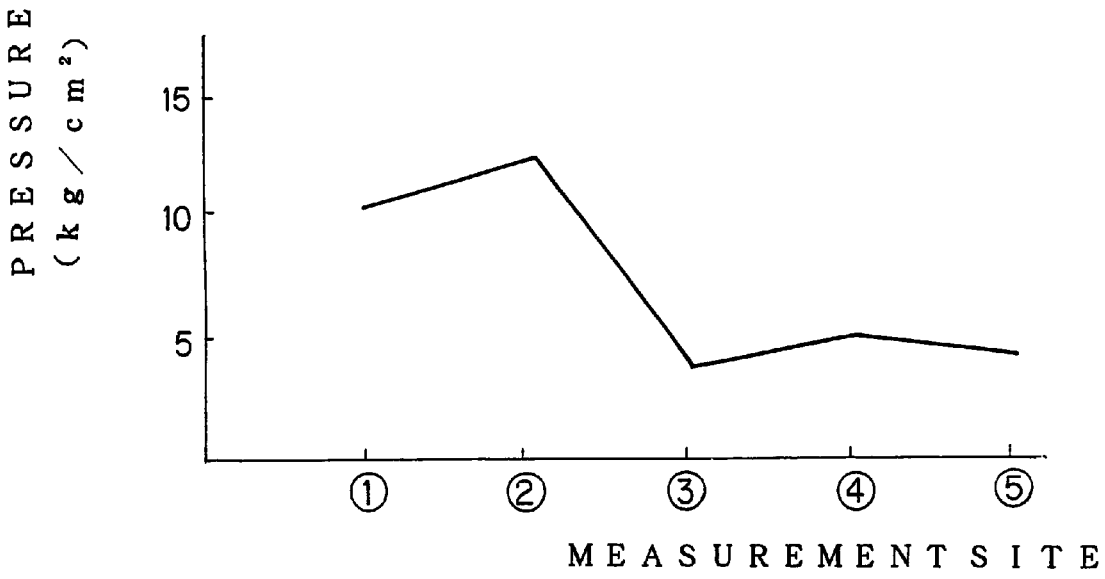
FIG. 6 is a graph showing the results of the pressure measurement test of Reference Example 1.

As the holding member, there was used a non intumescent mat made of a ceramic fiber [Maftec (trade name), a product of Mitsubishi Chemical Corporation]. As the pressure sensor, there was used Tactile Sensor (trade name) produced by Nitta K.K. The results are shown in FIG. 6.

Reference Example 2

There were measured the pressures applied to various sites of a honeycomb structure when the honeycomb structure was accommodated in a metal case according to a tourniquet method to form a gas duct.

Measurement of pressure was conducted as follows.

Figure 7:
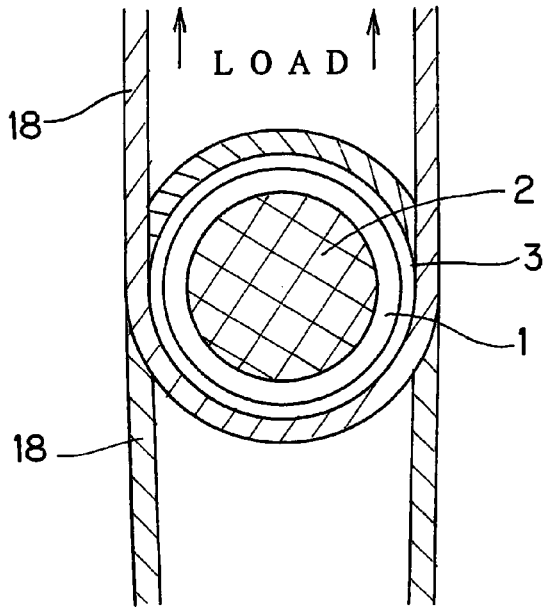
FIG. 7 is a schematic view showing the pressure measurement test method employed in Reference Example 2.
Figure 8:
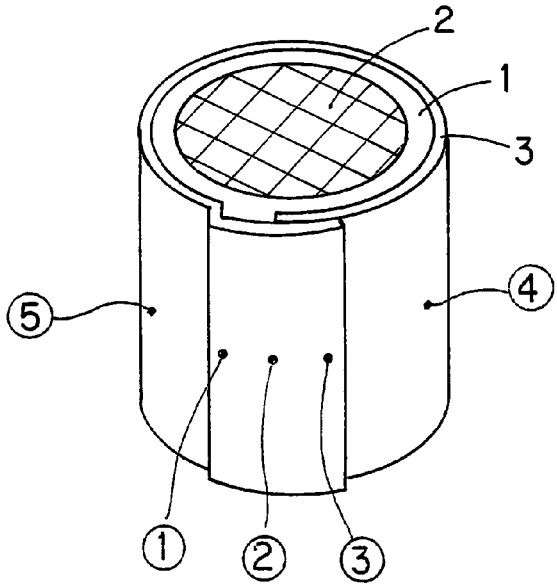
FIG. 8 is a perspective view showing the measurement sites in the pressure measurement test of Reference Example 2.
Figure 9:
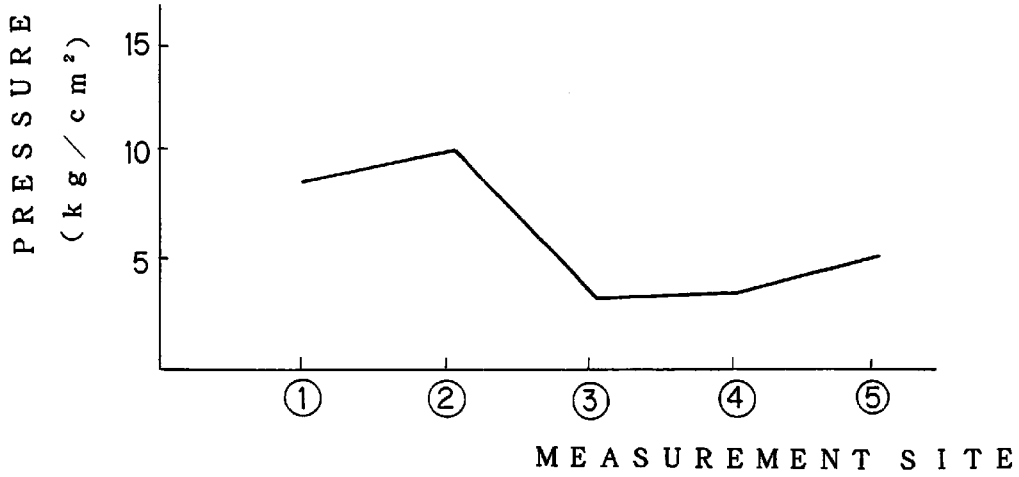
FIG. 9 is a graph showing the results of the pressure measurement test of Reference Example 2.

A holding member 1 was wound round the outer surface of a honeycomb structure 2 having a sheet-shaped pressure sensor thereon. The resulting material was accommodated in a metal case 3 as shown in FIG. 3(*b*). Then, as shown in FIG. 7, wire ropes 18 were wound round the metal case 3, and a load was applied so that the set pressure became 4 kg/cm$^2$. Pressure measurement was made at 5 sites shown in FIG. 8. The results are shown in FIG. 9. The holding member and pressure sensor used were the same as those used in Reference Example 1.

As is clear from FIG. 6 and FIG. 9, a high pressure is applied to the honeycomb structure at the connected area and its vicinity of the holding member or at the inner end of the overlapped two ends of the metal plate.

Reference Example 3

Figure 10:
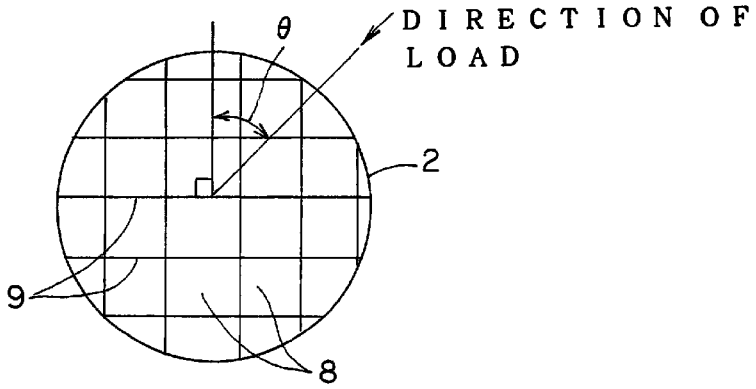
FIG. 10 is a perspective view showing the direction of a force applied to a honeycomb structure in the fracture strength measurement test of Reference Example 3.

A cylindrical ceramic honeycomb structure was measured for fracture strength by applying a force thereto from various angles as shown in FIG. 10. The honeycomb structure had a sectional diameter of 103 mm, a length of 120 mm, a partition wall thickness of 0.09 mm and a cell density of 60 cells/cm$^2$. The results are shown in FIG. 11.

Figure 11:
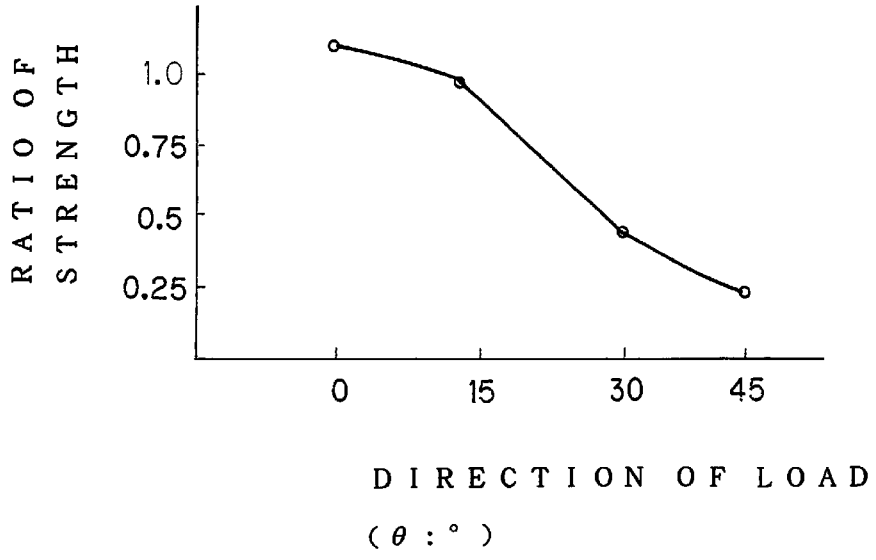
FIG. 11 is a graph showing the results of the fracture strength measurement test of Reference Example 3.

As is clear from FIG. 11, the honeycomb structure is strongest to a force perpendicular to the partition walls and weakest to a force of 45° to the partition walls.

In the gas duct of the present invention, the ceramic honeycomb structure is not fractured during the canning even when the honeycomb structure has thin partition walls; therefore, the caning operation of a honeycomb structure having thin partition walls (this operation need be conducted carefully) can be made efficiently. Since it is possible to use a honeycomb structure having thin partition walls in the present gas duct, when the honeycomb structure is used as, for example, a catalyst for exhaust gas purification, the early activation of catalyst during cold start is possible owing to the reduced heat capacity of catalyst; exhaust gas purifiability is improved; and the gas duct can be made small.

What is claimed:

1. A ceramic honeycomb gas duct assembly, comprising:

a metal case having an inner surface;

a ceramic honeycomb structure in the metal case, the honeycomb structure comprising an outer surface having a length and a curved circumference, a plurality of planar partition walls extending lengthwise within the structure and forming tetragonal cells of the honeycomb structure with a first set of partition walls forming sides of the cells and a second set of partition walls forming a top and a bottom of the cells, all partition walls bound by the outer surface; and a holding member between the outer surface of the honeycomb structure and the inner surface of the metal case, the holding member comprising two mutually connectable ends, said holding member being wound around the outer surface of the ceramic honeycomb structure with the two mutually connectable ends engaging each other at a connection area, and said connection area being located to face substantially perpendicularly either the first set of partition walls or the second set of partition walls constituting the honeycomb structure, said wound holding member holding the honeycomb structure in a state that said wound holding member is stuffed into the metal case from one opening of the metal case so as to be accommodated therein, wherein the width of the connection area of the holding member comprises 5 to 15% of the length of the circumference of the holding member.

2. The assembly of claim 1, wherein said holding member is a sheet that is wound around said honeycomb structure, and the honeycomb structure and wound holding member are within the metal case.

3. The assembly of claim 1, wherein the partition walls of the honeycomb structure have a thickness of less than 0.10 mm.

4. The assembly of claim 1, further comprising an exhaust gas purification system, wherein the honeycomb structure comprises a catalyst in said exhaust gas purification system for purification of exhaust gas.

5. The assembly of claim 1, wherein the holding member is a ceramic fiber mat.

6. The assembly of claim 1, wherein the holding member has a compressed surface pressure of two times higher or less at a temperature range at which the gas duct is in actual use than at normal temperature.

7. A ceramic honeycomb gas duct assembly, comprising:

a metal case having an inner surface and a doubly thick region defined by overlapped portions of the case;

a ceramic honeycomb structure in the metal case, the honeycomb structure comprising an outer surface having a length and a curved circumference, a plurality of planar partition walls extending throughout the length of the structure and forming tetragonal cells of the honeycomb structure with a first set of partition walls forming sides of the cells and a second set of partition walls forming a top and a bottom of the cells, all partition walls bound by the outer surface; and a holding member between the outer surface of the ceramic honeycomb structure and the inner surface of the metal case, the holding member comprising two mutually connectable ends, wherein the holding member is wound around the outer surface of the honeycomb structure with the two mutually connectable ends engaging each other at a connection area, and wherein the width of the connection area of the holding member comprises 5 to 15% of the length of the circumference of the holding member, the metal case is formed by a metal plate wound around the holding member so that the two ends of the metal plate are overlapped with each other and clamped with a tourniquet, and the overlapped two ends located to face substantially perpendicularly either the first set of partition walls or the second set of partition walls constituting the honeycomb structure.

8. The assembly of claim 7, wherein the partition walls of the honeycomb structure have a thickness of less than 0.10 mm.

9. The assembly of claim 7, further comprising an exhaust gas purification system, wherein the honeycomb structure comprises a catalyst in said exhaust gas purification system for purification of exhaust gas.

10. The assembly of claim 7, wherein the holding member is a ceramic fiber mat.

11. The assembly of claim 7, wherein the holding member has a compressed surface pressure of two times higher or less at a temperature range at which the gas duct is in actual use than at normal temperature.

* * * * *